US006599439B2

(12) United States Patent
Iyengar et al.

(10) Patent No.: US 6,599,439 B2
(45) **Date of Patent: *Jul. 29, 2003**

(54) DURABLE MAGNETORHEOLOGICAL FLUID COMPOSITIONS

(75) Inventors: Vardarajan R. Iyengar, Macomb, MI (US); Robert T. Foister, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/737,298

(22) Filed: Dec. 14, 2000

(65) Prior Publication Data

US 2001/0045540 A1 Nov. 29, 2001

Related U.S. Application Data

(60) Provisional application No. 60/193,914, filed on Mar. 31, 2000, and provisional application No. 60/170,671, filed on Dec. 14, 1999.

(51) Int. Cl.[7] ..... H01F 1/44
(52) U.S. Cl. ..... 252/62.52
(58) Field of Search ..... 252/62.52

(56) References Cited

U.S. PATENT DOCUMENTS

| | | | | | |
|---|---|---|---|---|---|
| 2,575,360 | A | | 11/1951 | Rabinow | 252/62.52 |
| 4,992,190 | A | | 2/1991 | Shtarkman | 252/62.52 |
| 5,167,850 | A | | 12/1992 | Shtarkman | 252/62.52 |
| 5,354,488 | A | | 10/1994 | Shtarkman | 252/62.56 |
| 5,382,373 | A | | 1/1995 | Carlson et al. | 252/62.55 |
| 5,578,238 | A | | 11/1996 | Weiss et al. | 252/62.52 |
| 5,599,474 | A | * | 2/1997 | Weiss et al. | 252/62.52 |
| 5,645,752 | A | | 7/1997 | Weiss et al. | 252/62.52 |
| 5,667,715 | A | * | 9/1997 | Foister | 252/62.52 |
| 5,670,077 | A | | 9/1997 | Carlson et al. | 252/62.52 |
| 5,683,615 | A | | 11/1997 | Munoz | 252/62.52 |
| 5,705,085 | A | | 1/1998 | Munoz et al. | 252/62.52 |
| 5,900,184 | A | | 5/1999 | Weiss et al. | 252/62.52 |
| 5,906,767 | A | | 5/1999 | Karol et al. | 252/62.52 |
| 6,027,664 | A | | 2/2000 | Weiss et al. | 252/62.52 |
| 6,149,832 | A | * | 11/2000 | Foister | 252/62.52 |
| 2001/0032961 | A1 | * | 10/2001 | Iyengar | 252/62.62 |

OTHER PUBLICATIONS

Some Material Problems in Magnetic Fluids; P.C. Scholten; Apr. 21, 1987; pp. 331–340.

* cited by examiner

*Primary Examiner*—C. Melissa Koslow
(74) *Attorney, Agent, or Firm*—Scott A. McBain

(57) ABSTRACT

A durable magnetorheological fluid suitable for use in high compression vibration dampening devices comprising mechanically hard magnetizable particles of unreduced carbonyl iron, cobalt-iron alloys, or mixtures thereof, a carrier fluid of a mixture of polyalphaolefin and a plasticizer, unreduced fumed silica and optionally an ethoxylated amine.

11 Claims, 2 Drawing Sheets

DURABLE MAGNETORHEOLOGICAL FLUID COMPOSITIONS

CROSS-REFERENCE TO RELATED APPLICATIONS

This application claims the benefit of U.S. Provisional Patent Application Ser. No. 60/193,914, filed Mar. 31, 2000 and U.S. Provisional Patent Application Ser. No. 60/170,671, filed Dec. 14, 1999.

TECHNICAL FIELD

The present invention is directed to magnetorheological (MR) fluids suitable for use in controllable high compression vibration dampening devices. More specifically, the invention is directed to MR fluids that provide durability over long-term use in controllable high compression vibration dampening devices. The MR fluids of the present invention are comprised of mechanically hard magnetizable particles, a carrier fluid derived from a polyalphaolefin and a plasticizer, and a non-oligomeric thixotropic agent. The MR fluid formulations of the present invention have been found to uniquely provide long-term durability in magnetically controllable high compression vibration dampening devices.

BACKGROUND OF THE INVENTION

Magnetorheological (MR) fluids are substances that exhibit the rather unique property of being able to reversibly change their apparent viscosity through the application of a magnetic field. For a MR fluid, the apparent viscosity and related flow characteristics of the fluid can be varied by controlling the applied magnetic field. Such fluids have wide application in vibration dampening devices such as, for example, shock absorbers, vibration dampers, force/torque transfer (clutch) devices, and the like, and especially in systems in which variable control of the applied dampening/force is desirable.

MR fluids are generally suspensions of finely divided magnetizable particles in a base carrier liquid. The particles are typically selected from iron, nickel, cobalt, and their magnetizable alloys. The base carrier liquid is generally a mineral oil, synthetic hydrocarbon, water, silicone oil, esterified fatty acid or other suitable organic liquid.

For commercial applications, the composition of MR fluids must have certain characteristics relating to durability, stability, viscosity, yield stress and volatility. With respect to durability, the fluid must be able to remain useful over a long period of time and must be minimally abrasive to the device in which it is housed. In MR fluids that contain metal particles, the natural selection has been toward those metal particles that are least abrasive, such as mechanically soft and compressible particles. Limited work has been done with mechanically hard particles due to their inherent abrasiveness and difficulty in creating stable fluid formulations. With respect to stability, the fluid formulation must be such that it limits particle settling. Thickeners and thixotropic agents have been used for this purpose, but it is important to select an agent that limits settling, while also limiting the apparent viscosity of the fluid in the "off-state"(i.e., when no magnetic field is applied). With respect to yield stress, the fluid formulation must be such that in the "on-state" (i.e., when a magnetic field is applied) the fluid provides the desired dampening. With respect to volatility, it is desirable to select a fluid that has the lowest volatility without compromising on the viscosity of the fluid. Accordingly, the formulation of MR fluids is to a large degree dependent on the individual components selected.

The magnetizable particles used in prior art MR fluids have generally been selected from metal particles that are mechanically soft and easily compressible and which exhibit lower abrasion and wear to component surfaces. The magnetizable particle typically used in such prior art MR fluids has been reduced carbonyl iron that is known to be a mechanically soft and easily compressible metal particle having a nominal particle size of about 6–9 microns and a hardness of B50 on the Rockwell scale (generally equivalent to the hardness of brass). Examples of such MR fluids are illustrated, for example, in U.S. Pat. No. 4,992,190, and U.S. Pat. No. 5,167,850.

Typical grades of soft, reduced carbonyl iron available commercially are CL, CM, CS, CN, SP, SQ, SL, SD, SB, and SM grades manufactured by BASF, and the R-2430, R-2410, R-1510, R-1470, R-1430, R-1521, and R-2521 grades manufactured by ISP Technologies, Inc. These iron particles are magnetically soft, i.e., they magnetize under a magnetic field, but they lose their magnetism when the magnetic field is turned off. This soft magnetism allows chain formation and breakage, thus providing reversible off-state and on-state properties.

Various other metals and metal alloys have been disclosed for use by others, but the preferred magnetizable particle selected for use in MR fluids has remained reduced carbonyl iron. For example, U.S. Pat. No. 5,683,615, which relates to a MR fluid comprising magnetic-responsive particles with an average particle size distribution of about 1 to 100 microns, a carrier fluid, and at least one thiophosphorus or thiocarbamate, describes the use of high purity carbonyl iron as preferred for use in their fluid and select reduced carbonyl iron as the particle in their MR fluids. This selection of reduced carbonyl iron as the elected magnetic-responsive particle is similarly shown, for example, in U.S. Pat. No. 5,705,085, which relates to a MR fluid comprising magnetic-responsive particles with an average particle size distribution of about 1 to 100 microns, a carrier fluid, and at least one organomolybdenum; and also, in U.S. Pat. No. 5,906,767, which relates to a MR fluid comprising magnetic-responsive particles with an average particle size distribution of about 1 to 100 microns, a carrier fluid, and a phosphorus additive.

It is noted that U.S. Pat. No. 5,645,752, does disclose the use of a mechanically hard magnetizable particle, but it is distinguished over the present invention in that it does not provide a durable MR fluid formulation. U.S. Pat. No. 5,645,752, relates to a MR fluid comprising magnetic particles having a particle diameter ranging from about 1 to 500 microns, a carrier fluid and a thixotropic additive specifically limited to an oligomeric compound or a polymer-modified metal oxide.

The aforementioned MR fluids have proven to be useful in certain types of controllable vibration dampening devices in which the applied force is along a single axis, such as may be encountered with a rod and piston shock absorber that is mounted vertically (to a suspension system) and the applied force (or load) to the shock absorber is directed along the direction of the piston rod (i.e., vertically).

In many recent automotive applications, however, vibration dampening devices such as shock absorbers are no longer being solely mounted vertically in relation to the vehicle chassis and suspension system. Due to space limitations, and vehicle system requirements, it has become necessary in several applications for shock absorbers to be designed so that they can be mounted non-vertically. While the load forces may remain vertical in relation to the vehicle chassis, the applied forces to such non-vertically mounted shock absorbers are along multiple axes. This non-vertical force is referred to as the "side load."

To accommodate the forces created by the side load, it has become necessary to redesign shock absorber systems to accommodate non-vertical applications. The primary efforts in this regard have been to redesign the shock tube and the piston, including hardening of the inner tube surface and plating of the surfaces of the piston head that come into contact with the inner tube surface.

MR fluids that contain soft, reduced carbonyl iron particles and use fumed silica as the thixotropic agent are known to thicken substantially during durability testing in dampers that have both a side load and a damping load. This thickening or paste formation causes the damping loads to increase sharply, thus compromising damper performance.

Several mechanisms, working individually or in combination, are believed to promote paste formation in MR fluids including the following:

(1) The action of the side load and the high rates of shear can cause severe deformation of the soft iron particles. Flattened and broken iron particles become adhered to each other when brought together under the influence of the magnetic field and then do not separate when the magnetic field is turned off. This causes agglomeration of the iron particles, resulting in fluid thickening.

(2) Fumed silica particles can mechanically bond to deformed soft iron particles due to the action of the side load. FIG. 1 shows an example of reduced carbonyl iron particles in an unused MR fluid; and FIG. 2 shows the particles in that fluid after 1 Million cycles of durability. The reduced iron particles after durability testing exhibit severe deformation and the fumed silica particles (seen as irregular fuzzy particles in FIG. 2) are mechanically attached to the iron particles. These fumed silica particles could not be removed from the iron particles using either solvent extraction or ultrasonic de-agglomeration techniques. It is believed that this mechanism can accelerate the agglomeration of the iron particles, resulting in quicker fluid thickening.

(3) When iron particles are deformed and broken, fresh pure iron is exposed. These fine particles of pure iron can act as catalysts and promote free radical polymerization of the carrier liquid. The deformation and breakage of such soft particles can accelerate polymerization of the carrier fluid molecules by catalysis and free radical mechanisms, thereby thickening the fluid.

While a durable MR shock absorber has been designed to withstand the side load on non-vertically mounted configurations, there is a need for correspondingly durable MR fluids. The present invention is directed to providing such durable MR fluids that address the desired yield stress properties for the device while exhibiting in the fluid long-term durability, sufficiently low viscosity and minimal particle settling, and to the device components minimal abrasion and wear.

SUMMARY OF THE INVENTION

The present invention is directed to durable MR fluid formulations comprising mechanically hard magnetizable particles, a carrier fluid derived from a polyalphaolefin and a plasticizer, and a non-oligomeric thixotropic agent.

It has been found that prior art formulations of MR fluids that are based on the use of mechanically soft magnetizable particles such as the reduced form of carbonyl iron are unable to maintain particle morphology and fluid consistency when subjected to long-term stress. FIGS. 1 and 2 show SEM photomicrographs of a MR fluid formulated according to fluids of the prior art using reduced carbonyl iron. In FIG. 1, the unused MR fluid shows that the particles have a spherical particle morphology. In FIG. 2, following 1 million cycles with a 100 Newton side load, however, the particle morphology has been completely disrupted. This is contrasted with the SEM photomicrographs of a MR fluid of the present invention, based on a formulation of the present invention using unreduced carbonyl iron, as shown in FIGS. 3 and 4. FIG. 3 shows the unused fluid; and FIG. 4 shows the fluid following 1 million cycles with a 100 Newton side load. As can be seen, the unreduced carbonyl iron particles in the MR fluid of FIGS. 3 and 4 substantially maintained their original spherical morphology and consistency.

DESCRIPTION OF THE PREFERRED EMBODIMENT

Figure 1:
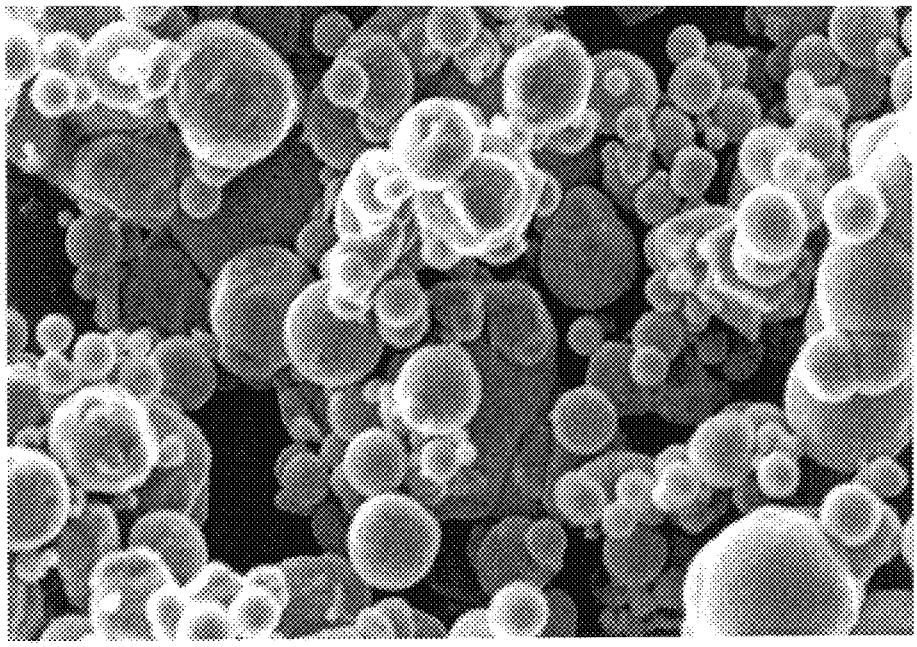
FIG. 1 shows a SEM micrograph of an unused MR fluid comprised of reduced carbonyl iron particles suspended in a carrier fluid similar to fluids of the prior art.
Figure 2:
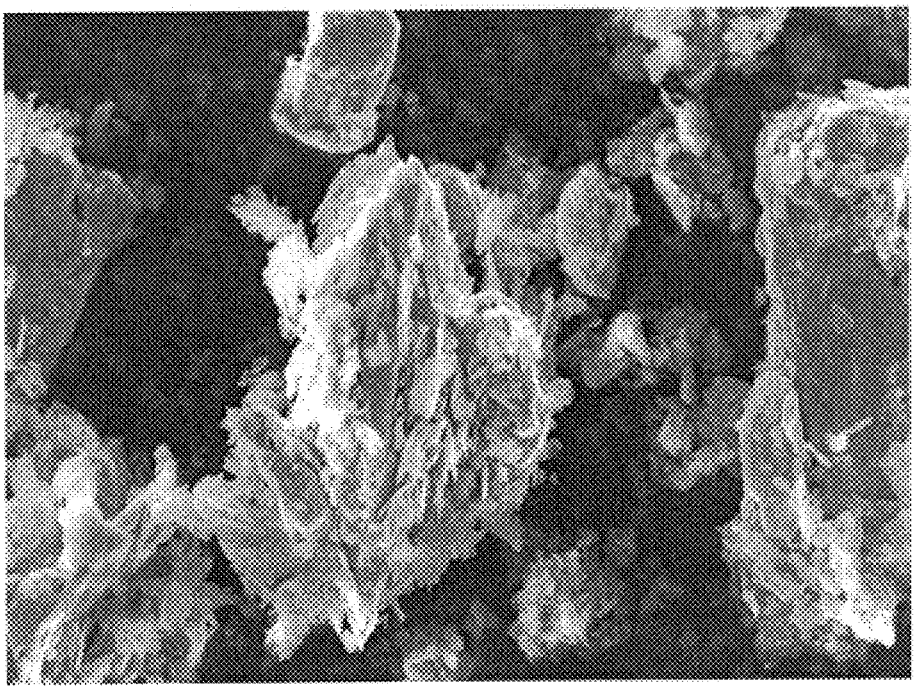
FIG. 2 shows a SEM micrograph of the MR fluid of FIG. 1 after 1 million cycles with a 100 Newton side load.
Figure 3:
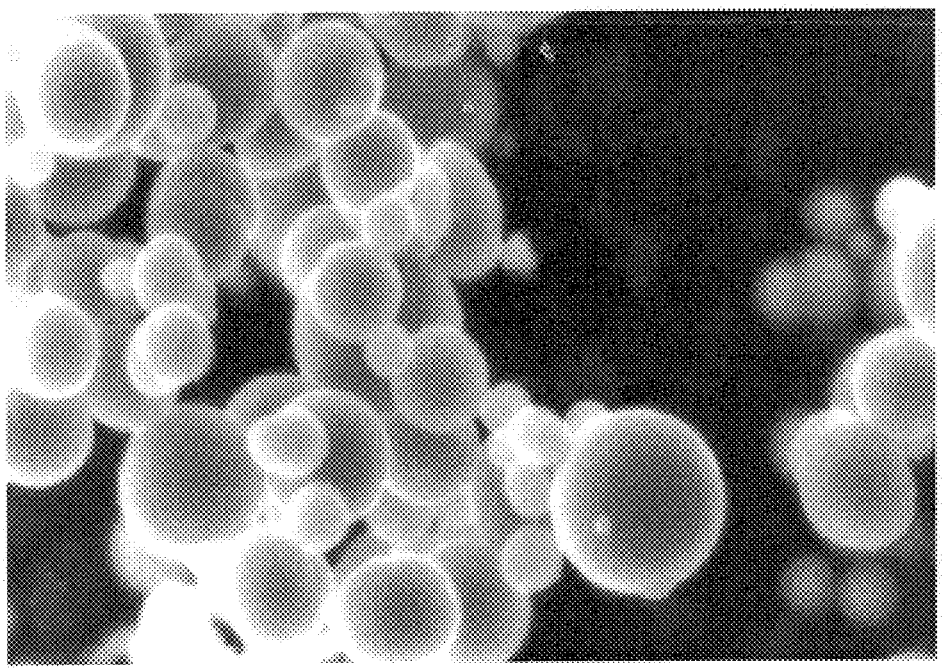
FIG. 3 shows a SEM micrograph of an unused MR fluid of the present invention comprised of unreduced carbonyl iron particles suspended in the carrier fluid of FIG. 1.
Figure 4:
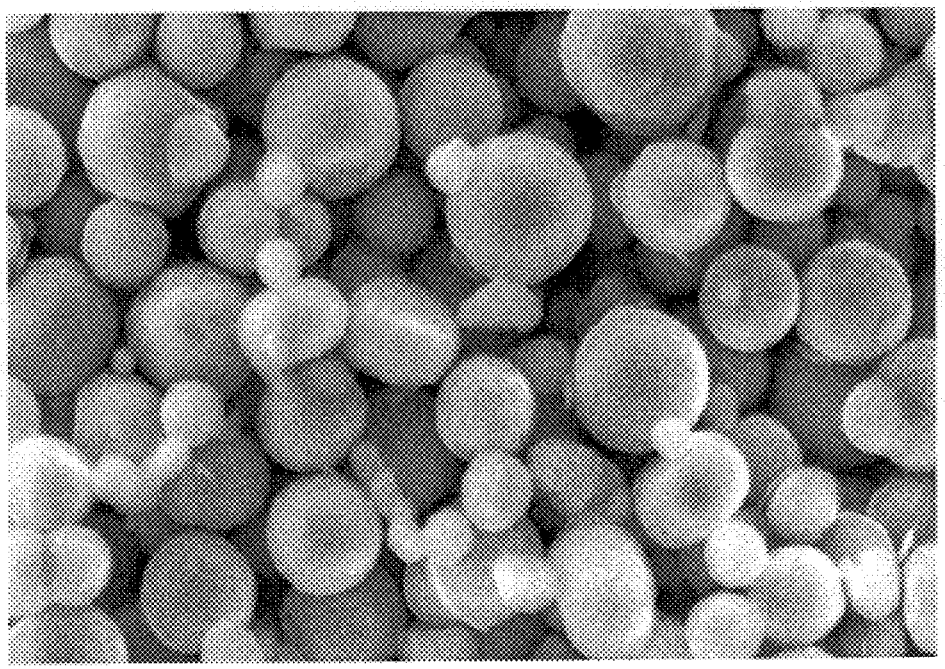
FIG. 4 shows a SEM micrograph of the MR fluid of FIG. 3 after 1 million cycles with a 100 Newton side load.

The MR fluids of the present invention are comprised of mechanically hard magnetizable particles, a carrier fluid derived from a polyalphaolefin and a plasticizer, and a non-oligomeric thixotropic agent.

The magnetizable particles of the invention generally include all magnetizable metal and metal alloy particles having a hardness of greater than about B50 on the Rockwell scale (the hardness of reduced carbonyl iron) and preferably about C65 on the Rockwell scale (with C65 representing the hardness of tool steel). The metals specifically contemplated include unreduced carbonyl iron (having a hardness greater than B50 to about C65 on the Rockwell Scale) and iron-cobalt alloys. Examples of preferred metals include, BASF carbonyl iron grades HS, HL, HM, HF and HQ, International Specialty Products (ISP) carbonyl iron grades S-3700, S-1640 and S-2701 and Carpenter Technology cobalt iron alloy grade HYPERCO™.

While we have seen excellent results with unreduced carbonyl iron particles such as BASF grade HS, it is recognized that similar results could be obtained with iron particles that have hardness somewhat less than C65 but significantly greater than B50 on the Rockwell scale. Pure iron is soft and ductile; the hardness of iron is increased by the addition of small quantities of impurities such as Nitrogen and Carbon. For example, reduced carbonyl iron such as BASF grade CM contains 0.008% Carbon and 0.01% Nitrogen, whereas unreduced carbonyl iron such as BASF grade HS contains 0.74% Carbon and 0.78% Nitrogen. It is believed and specifically contemplated that iron powders containing intermediate levels of Carbon (greater than 0.008% and less than 0.74%) and Nitrogen (greater than 0.01% and less than 0.78%) would be useful in the MR fluids of the invention.

In a MR fluid of the present invention, the amount of magnetizable particle used is a volume fraction of the total volume of the fluid, and is in the range of about 0.1 to about 0.6, with a preferred range of about 0.15 to about 0.3. The nominal particle size of the magnetizable particles should be no greater than about 10 microns, preferably less than about 5 microns, and most preferably about 1–2 microns.

The carrier fluid of the present invention comprises a polyalphaolefin (PAO) and a plasticizer. Preferred PAO's include dimers and trimers of decene and dodecene, such as Chevron SYNFLUID® 2.5 (a dimer of 1-dodecene), Chevron SYNFLUID® 2 (a dimer of decene), Chevron SYNFLUID® 4 (a trimer of decene), Mobil PAO SHF 21 (a dimer of decene), Mobil PAO SHF 41 (a trimer of decene) and Amoco DURASYN™ 170, or mixtures thereof.

It has been found that while PAO is an excellent carrier fluid, over time, it tends to slightly shrink the fluid seals used in most MR dampening devices. To counteract this effect, it has been discovered that an important component in the formulation of durable MR fluids is a plasticizer that acts to provide seal swell. It has also been found that the use of a plasticizer can provide additional advantages with respect to durability. For example, it has been found that the plasticizer regulates seal swell and can thereby help to accommodate for the loss of seal material resulting from wear. Preferred plasticizers include dioctyl sebacates, dioctyl adipates, mixed alkyl adipate diesters and hindered polyol esters, or mixtures thereof. Examples of such preferred plasticizers include UNIFLEX™ DOS, UNIFLEX™ DOA, UNIFLEX™ 250 and UNFLEX™ 207-D, all available from Arizona Chemical.

The amount of the PAO to plasticizer used in the invention is a volume ratio of PAO to DOS in the range of about 1 to about 10, and preferably in the range of about 3 to about 6. It is preferred that a dioctyl sebacate such as UNIFLEX™ DOS be used.

The thixotropic agent of the present invention may be selected from any thixotrope that is not an oligomeric compound and is not a polymer-modified metal oxide. The preferred thixotrope is untreated fumed silica that is produced by the vapor phase hydrolysis of silicon tetrachloride in a hydrogen oxygen flame. The process creates three-dimensional chain-like aggregates of sintered silicon dioxide particles having a length of about 0.2 to about 0.3 microns. In the present invention grades of untreated fumed silica having a surface area of greater than or equal to about 300 $m^2/g$ are preferred, for example, about 300 $m^2/g$ to about 350 $m^2/g$ or greater than about 350 $m^2/g$. Examples of such untreated fumed silicas include CAB-O-SIL® grades EH-5, HS-5, H-5 and MS-55, available from Cabot Corporation.

The amount of untreated fumed silica used in the present invention is a weight fraction of the total weight of the liquid components and ranges from about 0.01 to about 0.1, with the preferred range being about 0.03 to about 0.05. The preferred grade of untreated silica has a surface area of greater than about 350 $m^2/g$ such as, for example, CAB-O-SIL® EH-5.

The MR fluids of the present invention may further include anti-wear and anti-friction agents known in the art. The amount of each of these additives, as used in the present invention, is dependent upon the total weight of the PAO and the plasticizer, the primary liquid components. It is contemplated that the weight fraction of the anti-wear additive to the PAO and the plasticizer should be in the range of about 0 to about 0.05 and the weight fraction of the anti-friction additive to the PAO and the plasticizer should be in the range of about 0 to about 0.1. Examples of preferred anti-wear agents include zinc dialkyl dithiophosphate (ZDDP) such as available from Lubrizol Corporation (e.g., grades 1395 and 677A) and Ethyl Corporation (e.g., grades HITEC™ 7197 and HITEC™ 680). Examples of preferred anti-friction agents include organomolybdenums (MOLY) such as NAUGALUBE® MolyFM 2543 available from C.K. Witco and MOLYVAN® 855 available from R.T. Vanderbilt Company and alkyl amine oleates.

The MR fluids of the present invention may optionally include an amine for use in combination with the untreated fumed silica. In non-hydrogen bonding liquids, such as PAO, the addition of an amine improves the thixotropic efficiency of the untreated fumed silica by acting as bridging compounds between the surface hydroxyls of adjacent silica aggregates, extending the distance at which they can hydrogen bond. In the present invention, the preferred amine is an ethoxylated amine which is used in an amount based on the weight of the untreated fumed silica used. The weight fraction of the ethoxylated amine is in the range of about 0 to about 0.3, wherein the preferred weight fraction is in a range of about 0.1 to about 0.15. Examples of suitable ethoxylated amines include, ETHOMEEN® C-15, T-15 and S-15 from Akzo Nobel Chemicals Inc., and Tomah Products Inc.'s grades E-14-5, E-17-5 and E-S-2. The preferred ethoxylated amine for use in the present invention is ETHOMEEN® C-15.

The components of the preferred MR fluids of the present invention may be calculated in accordance with the following formulas. In order to simplify these calculations, the volume ratio of PAO to DOS has been pre-selected as 4. However, it is contemplated that alternative embodiments of the present invention may have volume ratios within the ranges set forth above (i.e., about 1 to about 10).

Component Properties

| Component | Density, g/cc | Volume, cc | Weight, gm |
|---|---|---|---|
| Iron Powder | $\rho_{Iron}$ | $V_{Iron}$ | $w_{Iron}$ |
| Fumed Silica | $\rho_{Silica}$ | $V_{Silica}$ | $w_{Silica}$ |
| PAO | $\rho_{Pao}$ | $V_{Pao}$ | $w_{Pao}$ |
| DOS | $\rho_{Dos}$ | $V_{Dos}$ | $w_{Dos}$ |
| ZDDP | $\rho_{Zddp}$ | $V_{Zddp}$ | $w_{Zddp}$ |
| MOLY | $\rho_{Moly}$ | $V_{Moly}$ | $w_{Moly}$ |
| C15 | $\rho_{C15}$ | $V_{C15}$ | $w_{C15}$ |

Fluid Formulation Parameters (i) $V_{Tot}$, the total volume, cc.

(ii) $\Phi_{Iron}$, the volume fraction of iron in the MR fluid.

(iii) The volume ratio of PAO to DOS is 4.

(iv) $\lambda$, the weight fraction of fumed silica with respect to the total weight of the liquid components.

(v) $f_{Zddp}$, the weight fraction of ZDDP with respect to the total weight of PAO and DOS.

(vi) $f_{Moly}$, the weight fraction of MOLY with respect to the total weight of PAO and DOS.

(vii) $f_{C15}$, the weight fraction of C15 with respect to the weight of the fumed silica.

Formulas

From Parameter (i)

$$V_{Tot}=V_{Iron}+V_{Silica}+V_{Pao}+V_{Dos}+V_{Zddp}+V_{Moly}+V_{C15} \quad (1)$$

From Parameter (ii)

$$w_{Iron}=\Phi_{Iron}\cdot V_{Tot}\cdot\rho_{Iron} \quad (2)$$

From Parameter (iii)

$$w_{Pao} = 4 \cdot w_{Dos} \cdot \frac{\rho_{Pao}}{\rho_{Dos}} \tag{3}$$

From Parameter (iv)

$$w_{Silica} = \lambda \cdot (w_{Pao} + w_{Dos} + w_{Zddp} + w_{Moly} + w_{C15}) \tag{4}$$

From Parameters (v), (vi), and (vii)

$$w_{Zddp} = f_{Zddp} \cdot (w_{Pao} + w_{Dos}) \tag{5}$$

$$w_{Moly} = f_{Moly} \cdot (w_{Pao} + w_{Dos}) \tag{6}$$

$$w_{C15} = f_{C15} \cdot (w_{Silica}) \tag{7}$$

Formula (1) Can Be Rewritten as Follows $$V_{Tot} = \frac{w_{Iron}}{\rho_{Iron}} + \frac{w_{Silica}}{\rho_{Silica}} + \frac{w_{Pao}}{\rho_{Pao}} + \frac{w_{Dos}}{\rho_{Dos}} + \frac{w_{Zddp}}{\rho_{Zddp}} + \frac{w_{Moly}}{\rho_{Moly}} + \frac{w_{C15}}{\rho_{C15}} \tag{8}$$

and, on combining with formulas (2), (3), (4), (5), (6), and (7) and solving for $w_{Dos}$:

$$w_{Dos} = \frac{V_{Tot} \cdot (1 - \Phi_{Iron})}{\left(\frac{x}{\rho_{Silica}} + \frac{5}{\rho_{Dos}} + y + x \cdot \frac{f_{C15}}{\rho_{C15}}\right)} \tag{9}$$

in which $$x = \frac{\lambda \cdot (1 + f_{Zddp} + f_{Moly})}{1 - \lambda \cdot f_{C15}} \cdot \left(4\frac{\rho_{Pao}}{\rho_{Dos}} + 1\right) \tag{10}$$

and $$y = \left(\frac{f_{Zddp}}{\rho_{Zddp}} + \frac{f_{Moly}}{\rho_{Moly}}\right) \cdot \left(4\frac{\rho_{Pao}}{\rho_{Dos}} + 1\right) \tag{11}$$

Formula (9) expresses the weight of the component DOS in terms of known and specified variables. After calculating the value of $W_{Dos}$, the other component weights can be calculated using the formulas shown above.

The following examples illustrate various aspects of the present invention, and are not intended to limit the scope of the invention.

EXAMPLES 1 & 2

In each example, the iron powder is unreduced carbonyl iron, BASF grade HS; the PAO is Chevron SYNFLUID® 2.5; the DOS (plasticizer) is UNIFLEX™ DOS; the fumed silica (thixotrope) is CAB-O-SIL® EH-5; the ZDDP (anti-wear) is LUBRIZOL® 1395; and the MOLY (anti-friction) is NAUGALUBE® MolyFM 2543. In Example 2, the C15 (ethoxylated amine) is ETHOMEEN® C-15.

| Component | Density, g/cc | Fluid Formulation Parameters | Weight, g |
|---|---|---|---|
| | | Example 1 | |
| Iron Powder | 7.65 | $\Phi_{Iron} = 0.2$ | 5791.05 |
| Fumed Silica | 2.1 | $\lambda = 0.04$ | 101.15 |

-continued

| Component | Density, g/cc | Fluid Formulation Parameters | Weight, g |
|---|---|---|---|
| PAO | 0.82 | Ratio to DOS = 4 | 1867.47 |
| DOS | 0.91 | Based on PAO | 518.11 |
| ZDDP | 1.18 | $f_{Zddp} = 0.03$ | 71.57 |
| MOLY | 0.988 | $f_{Moly} = 0.03$ | 71.57 |
| C-15 | 0.98 | $f_{C15} = 0.0$ | |
| | | Example 2 | |
| Iron Powder | 7.65 | $\Phi_{Iron} = 0.2$ | 5791.05 |
| Fumed Silica | 2.1 | $\lambda = 0.04$ | 101.21 |
| PAO | 0.82 | Ratio to DOS = 4 | 1861.11 |
| DOS | 0.91 | Based on PAO | 516.34 |
| ZDDP | 1.18 | $f_{Zddp} = 0.03$ | 71.32 |
| MOLY | 0.988 | $f_{Moly} = 0.03$ | 71.32 |
| C-15 | 0.98 | $f_{C15} = 0.1$ | 10.12 |

The MR fluids of Examples 1 and 2 were prepared in one gallon batches, as follows. The liquid components including the PAO, DOS, ZDDP, MOLY, and optionally the C15, are first mixed together under low shear conditions of about 200 to about 500 rpm. The fumed silica is then added to the liquid components and mixed for an additional 20 minutes. The iron powder is then slowly added under continuous mixing. The mixture of liquid and solid components is then further mixed for an additional 1 hour or until the iron powder is completely dispersed into the fluid, whichever is greater. The fluid is then subjected to high shear mixing at about 2500 to about 3500 rpm for a duration of about 10 minutes.

The MR fluid of Example 1 was put into a MR shock absorber and tested for durability according to the conditions set forth above. The MR fluid of Example 1 successfully withstood the durability conditions of 1 million cycles with a 100 Newton side load.

While the preferred embodiment of the present invention has been described so as to enable one skilled in the art to practice the durable magnetorheological fluid compositions, it is to be understood that variations and modifications may be employed without departing from the concept and intent of the present invention as defined by the following claims. The preceding description is intended to be exemplary and should not be used to limit the scope of the invention. The scope of the invention should be determined only by reference to the following claims.

What is claimed:

1. A durable magnetorheological fluid comprising:

a. a magnetizable particle component consisting of mechanically hard magnetizable particles having a hardness greater than B50 on the Rockwell scale and a particle size less than about 10 microns that is selected from the group consisting of unreduced carbonyl iron particles, cobalt iron alloy particles, and mixtures thereof;

b. a carrier fluid consisting essentially of polyalphaolefin and a plasticizer;

c. untreated fumed silica; and d. an ethoxylated amine.

2. A magnetorheological fluid of claim 1 wherein said polyalphaolefin is selected from the group consisting of dimers and trimers of decene, dimers and trimers of dodecene, and mixtures thereof, and said plasticizer is selected from the group consisting of dioctyl sebacate, dioctyl adipate, mixed alkyl adipate diesters, hindered polyol esters and mixtures thereof.

3. A magnetorheological fluid of claim 1 wherein said untreated fumed silica is produced by the vapor phase hydrolysis of silicon tetrachloride in a hydrogen oxygen flame having a surface area greater than about 300 $m^2/g$.

4. A durable magnetorheological fluid comprising:

a. mechanically hard magnetizable particles having a hardness greater than B50 on the Rockwell scale and a particle size less than about 10 microns that is selected from the group consisting of unreduced carbonyl iron particles, cobalt iron alloy particles, and mixtures thereof;

b. a carrier fluid consisting essentially of a mixture of a dimer of dodecene and dioctyl sebacate;

c. untreated fumed silica having a surface area of between about 300 $m^2/g$ to about 350 $m^2/g$; and d. an ethoxylated amine.

5. A magnetorheological fluid of claim 4 wherein said particles have an average particle size of less than about 5 microns.

6. A magnetorheological fluid of claim 5 wherein said particles are unreduced carbonyl iron having a hardness greater than B50 to about C65 on the Rockwell Scale.

7. A magnetorheological fluid of claim 6 wherein said particles of said unreduced carbonyl iron have a hardness of about C65 on the Rockwell Scale.

8. A magnetorheological fluid of claim 5 wherein said particles are a iron-cobalt alloy.

9. A magnetorheological fluid of claim 4 wherein said carrier fluid consists essentially of a mixture of a dimer of 1-dodecene and dioctyl sebacate in a volume ratio of 4.

10. A magnetorheological fluid of claim 4 further comprising an anti-wear additive, and an anti-friction additive.

11. A magnetorheological fluid comprising:

a. mechanically hard magnetizable particles of unreduced carbonyl iron having a hardness of about C65 on the Rockwell Scale and an average particle size of about 1 to 2 microns;

b. a carrier fluid consisting essentially of a mixture of a dimer of 1-dodecene and dioctyl sebacate in a volume ratio of 4;

c. untreated fumed silica having a surface area of greater than about 350 $m^2/g$; and d. an ethoxylated amine.

* * * * *